United States Patent [19]

Louw

[11] Patent Number: 4,828,155

[45] Date of Patent: May 9, 1989

[54] GARMENT HANGERS

[76] Inventor: Henry J. Louw, Dreyersdal Road, Bergvliet 7800, South Africa

[21] Appl. No.: 136,274

[22] Filed: Dec. 22, 1987

[30] Foreign Application Priority Data

Dec. 29, 1986 [ZA] South Africa ..... 86/9704

[51] Int. Cl.[4] ..... A47G 25/36; A47G 25/30; A47G 25/48

[52] U.S. Cl. ..... 223/85; 223/93; 24/545; 24/555; D6/326

[58] Field of Search ..... 223/85, 93, 96, 91; D6/315, 326, 327; 24/545, 555, 487

[56] References Cited

U.S. PATENT DOCUMENTS

| | | | |
|---|---|---|---|
| D. 220,891 | 6/1971 | Charak | D6/327 |
| 2,419,723 | 4/1947 | Mack, Sr. | 223/96 |
| 2,492,287 | 12/1949 | Hogan | 223/93 |
| 2,609,130 | 9/1952 | Burnell | 223/96 |
| 3,327,912 | 6/1967 | Blair | 223/85 |
| 3,570,729 | 3/1971 | Zuckerman | 223/96 |
| 4,623,079 | 11/1986 | Tendrup et al. | 223/85 |
| 4,629,102 | 12/1986 | Tendrup et al. | 223/85 |

FOREIGN PATENT DOCUMENTS

| | | | |
|---|---|---|---|
| 2406421 | 5/1979 | France | 223/96 |
| 1514978 | 6/1978 | United Kingdom | 223/96 |
| 2069332 | 8/1981 | United Kingdom | 223/85 |
| 2120542 | 12/1983 | United Kingdom | 223/96 |
| 2136682 | 9/1984 | United Kingdom | 223/93 |

*Primary Examiner*—Robert R. Mackey
*Attorney, Agent, or Firm*—Larson and Taylor

[57] ABSTRACT

A garment hanger includes an elongated bar member having two opposite ends; suspension means for suspending the bar member from a support, such as a rail; and garment support means at each of the opposite ends of the bar member. The garment support means each include an arm directed to the center of the bar member so that a space is formed between the arm and the bar member, a carrier element located at the free end of the arm on its side facing towards the bar member and an elongated pressing member supported by the carrier element. The pressing member is biassed towards the bar member by the arm and a part of a garment is receivable in between the pressing member and the bar member.

8 Claims, 2 Drawing Sheets

GARMENT HANGERS

FIELD OF INVENTION

The present invention relates to garment hangers.

SUMMARY OF INVENTION

According to the invention, a garment hanger includes an elongated bar member having two opposite ends; suspension means for suspending the bar member from a support; and garment support means at each of the opposite ends of the bar member for supporting garments from the hanger, each garment support means including an arm extending from the associated end of the bar member in a direction towards the center of the bar member and having a free end disposed so that a space is formed between the arm and the bar member, a carrier element located at the free end of the arm on the side thereof facing towards the bar member and an elongated pressing member supported by the carrier element so that the pressing member is biassed towards the bar member by the arm and so that a part of a garment is receivable in between the pressing member and the bar member, the arm of each garment support means pivotably supporting the associated pressing member and each pressing member being in the form of an elongated leg which is substantially centrally supported by the free end of the associated arm.

The arm of each garment support means may be located on the side of the bar member opposite to the suspension means.

The pressing member may have a curved part at its end facing towards the center of the bar member, the curved part being directed away from the bar member.

The pressing member and the carrier member may be of substantially T-shape.

The pressing member may abut against the bar member.

Each support means also may include a second arm directed to the center of the bar member and being located on the bar member opposite to the arm of the garment support means carrying a pressing member.

The hanger may be made of plastic material, and may be injection moulded.

BRIEF DESCRIPTION OF DRAWINGS

The invention will now be described by way of example with reference to the accompanying schematic drawings.

In the drawings, there is shown in

DETAILED DESCRIPTION OF DRAWINGS

Figures 1, 2, 3, 4:
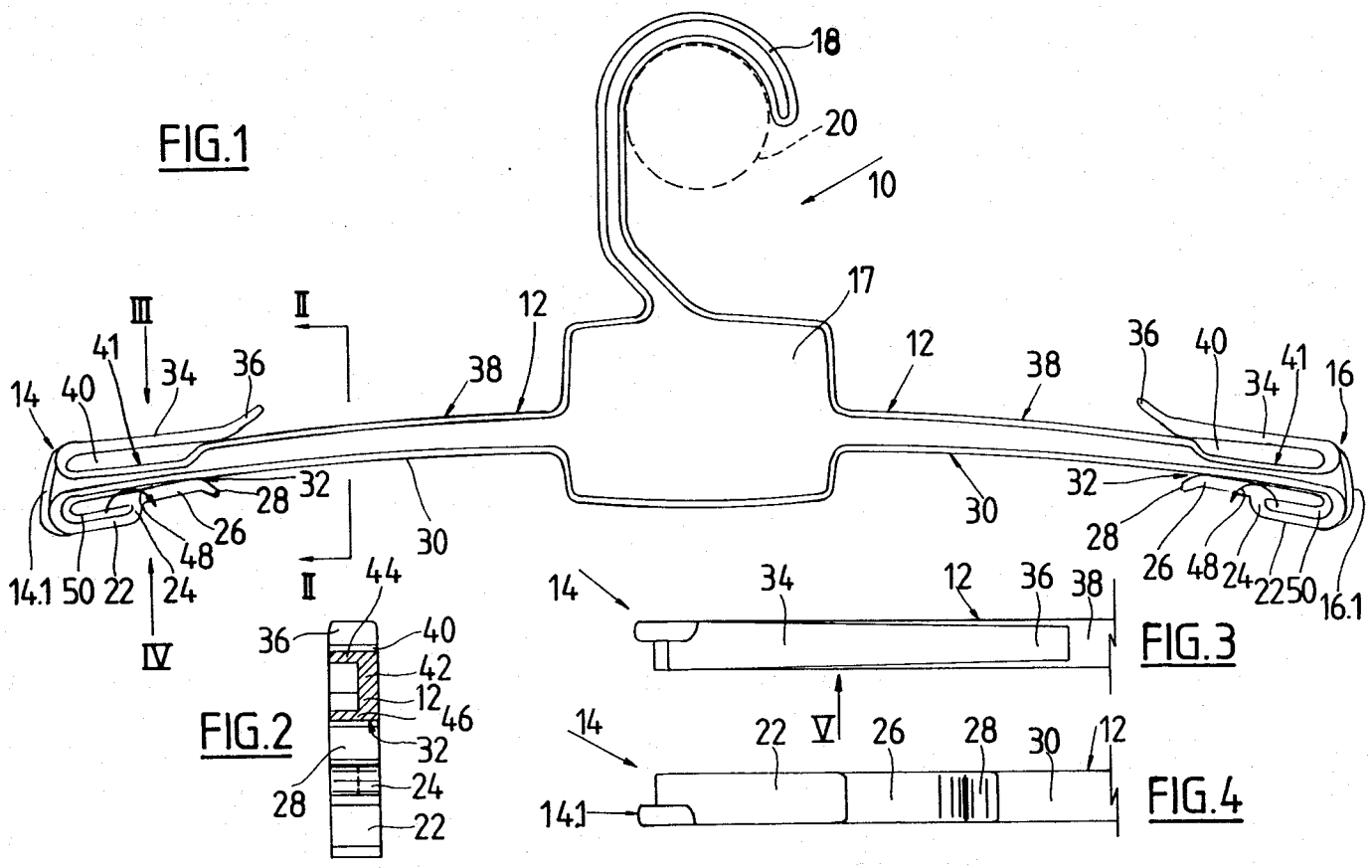
FIG. 1 a side view of a garment hanger in accordance with the invention.
FIG. 2 on a larger scale, a sectional end view seen along arrows II—II in FIG. 1.
FIG. 3 on a larger scale, a plan view of an end of the hanger seen along arrow III in FIG. 1.
FIG. 4 on a larger scale, a view from below on an end of the hanger seen along arrow IV in FIG. 1.

Referring to FIGS. 1 to 5 of the drawings, the hanger 10 includes an elongated bar 12 having garment support means 14, 16, respectively, at two opposite ends 14.1 and 16.1, a central part 17, and a suspension means in the form of a hook member 18 extending from the central part 17 for suspending the hanger 10 from a support (such as a rail indicated in dotted lines 20).

Each of the garment support means 14 and 16 includes an arm 22 extending from its respective end 14.1, 16.1 towards the central part 17 of the bar 12. The arm 22 supports a carrier element 24 at its free end, which in turn supports an elongated pressing arm or beam 26. The pressing arm 26 has an end 28 facing towards the central part 17 of the bar 12 and also facing away from the underside 30 of the bar 12 so that an insertion gap 32 is defined between the end 28 of the arm 26 and the underside 30 of the bar 12. As is shown, the arm 26 is in pressing contact with the underside 20 of the bar 12 in the region of the end 28.

Also extending from each of the ends 14.1, 16.1 is a further arm 34 having an end 36 facing away from the upperside 38 of the bar 12. The arm 34 defines a gap 40 between it and the upperside 41 of the bar 12.

As is shown in FIG. 2, the bar 12 is of U-shape having a thickened central part 42, an upper leg 44 and a lower leg 46. The legs 44, 46 are provided for rigidity.

The carrier 24 is narrower than the arm 26, so that the arm 26 can pivot sideways about the carrier 24.

In use, when a garment, such as a bra strap, is inserted into the gap 32, the arm 26 is pivotted about the carrier 24 in the direction indicated by arrow 48. When the strap reaches the position above the gap 50, defined between the arm 22 and the arm 26, the arm 26 is pivotted in a direction opposite to that indicated by arrow 48 to cause the arm 26 to come into contact with the underside 30 of the bar 12 in the region of the free end 28. Thereby the garment cannot be pulled out easily towards the central part 17.

Figure 5:
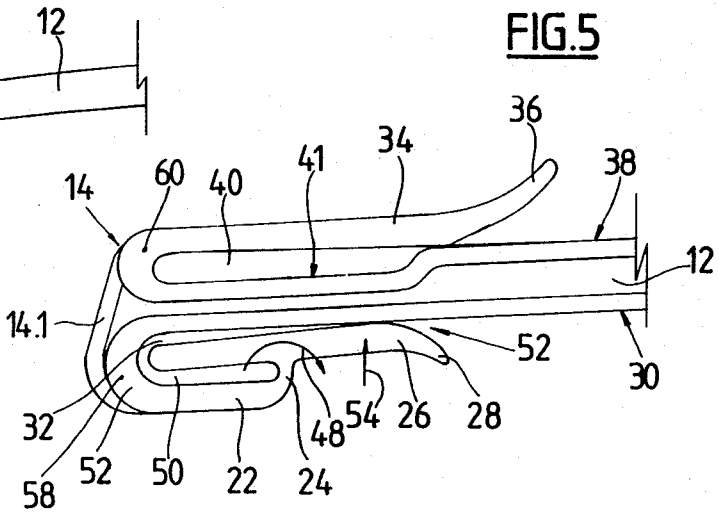
FIG. 5 a side view of an end of the hanger seen along arrow V in FIG. 3.

As is shown in FIG. 5 in particular, due to the manufacturing cooling shrinkage of the plastics material at the thickened end 52 of the arm 22, on cooling, the arm 22 is moved towards the bar 12 and the arm 26 is biased in the direction of arrow 54 towards the underside 30 of the bar 12 so that it is brought into pressing contact with the bar 12 at its end 28. As explained before, if for instance a strap is to be inserted, it is forced into the gap 32 and the arm 26 then tilts in the direction of arrow 48. Due to the biassing effect on the arm 26 towards the bar 12, a pressure is continued to be exercised on the strap irrespective of whether it is located above the carrier 24 or above the gap 50. If the strap is above the gap 50, the end of the arm 26 will again abut against the underside 30 of the bar 12 (depending on the thickness of the strap) so as thereby to close off the gap at that end between the arm 26 and the bar 12 and thus to prevent slip-out of the strap towards the central part 17.

Figure 6:
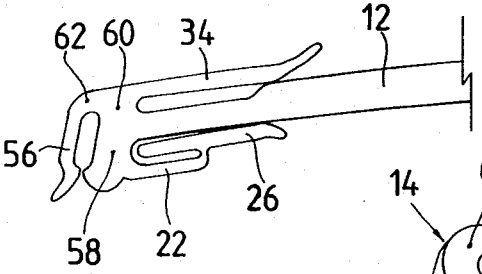
FIG. 6 a side view of an end of a hanger according to a variation in accordance with the invention.

FIG. 6 shows a further variation where an end clip 56 is provided at the end 14 of the bar 12. Otherwise the same reference numerals are used as in FIGS. 1 to 5.

The so-called "hot spots" at 58, 60, 62, respectively, during manufacturing cause the arms 22, 34 and clip 56 to bend (on cooling) towards the bar 12 and thereby to close off the gaps at the free ends thereof and bias the free ends towards the bar 12.

I claim:

1. A garment hanger, which includes an elongated bar member having two opposite ends; suspension means for suspending the bar member from a support; and garment support means at each of the opposite ends of the bar member for supporting garments from the hanger, each garment support means including an arm extending from the associated end of the bar member in a direction towards the center of the bar member and having a free end disposed so that a space is formed between the arm and the bar member, a carrier element located at the free end of the arm on the side thereof facing towards the bar member and an elongated pressing member supported by the carrier element so that the pressing member is biassed towards the bar member by the arm and so that a part of a garment is receivable in between the pressing member and the bar member, the arm of each garment support means pivotably supporting the associated pressing member and each pressing member being in the form of an elongated leg which is substantially centrally supported by the free end of the associated arm.

2. A hanger as claimed in claim 1, in which the arm of each garment support means is located on the side of the bar member opposite to the suspension means.

3. A hanger as claimed in claim 1, in which the pressing member has a curved part at its end facing towards the center of the bar member, the curved part being directed away from the bar member.

4. A hanger as claimed in claim 1, in which the pressing member and the carrier member are of substantially T-shape.

5. A hanger as claimed in claim 1, in which the pressing member abuts against the bar member.

6. A hanger as claimed in claim 1, in which each support means also includes a further arm directed to the center of the bar member and being located on the bar member opposite to the arm of the garment support means carrying a pressing member.

7. A hanger as claimed in claim 1, which is made of plastic material.

8. A hanger as claimed in claim 7, which is injection moulded.

* * * * *